US005080817A

United States Patent [19]

Meyer

[11] Patent Number: 5,080,817

[45] Date of Patent: Jan. 14, 1992

[54] CORROSION INHIBITOR FOR 2-CYCLE ENGINE OILS COMPRISING DODECENYL SUCCINIC ANHYDRIDE-PROPYLENE GLYCOL ESTERS

[75] Inventor: G. Richard Meyer, Sugarland, Tex.

[73] Assignee: Nalco Chemical Company, Naperville, Ill.

[21] Appl. No.: 584,268

[22] Filed: Sep. 18, 1990

[51] Int. Cl.[5] ..... C10M 129/76

[52] U.S. Cl. ..... 252/56 D

[58] Field of Search ..... 252/56 D; 560/198

[56] References Cited

U.S. PATENT DOCUMENTS

| | | | |
|---|---|---|---|
| 2,703,811 | 3/1955 | Smith, Jr. | 252/56 D |
| 2,929,786 | 3/1960 | Young et al. | 252/56 D |
| 2,993,773 | 7/1961 | Stromberg | 252/56 D |
| 3,045,042 | 7/1962 | Staker | 560/198 |
| 3,117,091 | 1/1964 | Staker | 252/56 |
| 3,813,228 | 5/1974 | Geiser | 252/51.5 A |
| 3,923,672 | 12/1975 | Durr, Jr. et al. | 252/51.5 A |
| 3,926,823 | 12/1975 | Durr et al. | 252/51.5 A |

FOREIGN PATENT DOCUMENTS

| | | | |
|---|---|---|---|
| 896376 | 5/1962 | United Kingdom | 2/3 |

*Primary Examiner*—Prince Willis, Jr.
*Assistant Examiner*—Jerry D. Johnson
*Attorney, Agent, or Firm*—Daniel N. Lundeen; Robert A. Miller

[57] ABSTRACT

A film-forming corrosion inhibitor suitable for use in 2-cycle engine oils is prepared from the reaction product of 1 mole of dodecenylsuccinic anhydride with 0.6–0.95 moles propylene glycol. The anhydride-glycol adduct is prepared in a relatively short reaction time, and the engine oil containing the corrosion inhibitor is compatible with other oil and fuel additive components, while industry standard performance properties are maintained.

13 Claims, No Drawings

CORROSION INHIBITOR FOR 2-CYCLE ENGINE OILS COMPRISING DODECENYL SUCCINIC ANHYDRIDE-PROPYLENE GLYCOL ESTERS

FIELD OF THE INVENTION

The present invention relates to a 2-cycle engine oil film-forming corrosion inhibitor, and more particularly to a corrosion inhibitor comprising an adduct mixture of dodecenylsuccinic anhydride (DDSA) and propylene glycol (PG).

BACKGROUND OF THE INVENTION 2-cycle engine oils are so noted because they both lubricate an engine and are burned along with a fuel. As a result, additive components in different makes of lubricants and fuels get mixed together. One such additive is a corrosion inhibitor added to engine lubricants to inhibit corrosion and rust in various engine components. Another additive is a fuel detergent especially prevalent in fuel injected engines subject to fouling and poor performance. A large increase in the number and kinds of fuel and oil additives entering the market increases the likelihood that unwanted side reactions between additives from different sources can occur. Not only are important engine protecting compounds consumed, thereby reducing engine protection, but performance-damaging and filter-clogging particulate products may be produced. Accordingly, there is need for a corrosion inhibitor which will not react with 2-cycle lubricant and fuel additive packages obtained from different commercial sources. This inhibitor must also conform to established industry performance standards.

Adducts of alkenylsuccinic anhydride and polyhydric alcohols are known in the art as rust inhibiting compounds employed in fuels for internal combustion engines. Both U.S. Pat. No. 3,117,091 and U. K. Patent 896,376 to Staker disclose a variety of such components which are stated to be suitable for use in internal combustion engines because they prevent rust from forming, and because fuel injection systems are not clogged or damaged by fuels containing the additives.

SUMMARY OF THE INVENTION

The reaction product of dodecenylsuccinic anhydride (DDSA) and propylene glycol (PG), in a proportion from about 0.6 to about 0.95 moles of PG per mole of DDSA, has been discovered to provide a film-forming corrosion-inhibiting additive for a 2-cycle engine oil. Quite surprisingly, this DDSA-PG adduct has been found to be compatible with other commercially available 2-cycle engine oils containing different additives, and in addition, can be prepared by a relatively rapid reaction.

In a preferred embodiment, a 2-cycle engine oil contains a corrosion-inhibiting amount of an additive comprised of a DDSA-PG adduct obtained by reacting from about 0.65 to about 0.9 moles of PG per mole of DDSA, more preferably from about 0.7 to about 0.85 moles of PG per mole of DDSA. The engine oil may comprise from about 1 to about 5, preferably from about 2 to about 4, pounds per thousand barrels (ptb) of the adduct.

In another embodiment of the present invention, a method for preparing a 2-cycle engine oil corrosion-inhibiting composition comprises the steps of charging a reaction vessel with a reactor feed comprised of PG and DDSA in a molar proportion of PG:DDSA from about 0.6 to about 0.95:1; reacting the feed to form a mixture of mono- and diesters of DDSA; and blending in a 2-cycle engine oil.

DETAILED DESCRIPTION OF THE INVENTION

In the present invention, it has been discovered that a reaction product of dodecenylsuccinic anhydride (DDSA) and propylene glycol (PG) in suitable proportion is singularly suited for use as a film-forming corrosion inhibiting additive for 2-cycle engine oils. DDSA reacts with PG to form a mixture of mono- and diesters of DDSA in a proportion which not only inhibits engine rust and corrosion formation, but is compatible with other commercially available 2-cycle engine oil packages, while maintaining industry standard 2-cycle engine oil performance properties. Furthermore, reaction time necessary to prepare the mono- and diester mixture is greatly reduced in contradistinction to the diester alone of the prior art.

DDSA undergoes partial esterification with PG to produce primarily a product mixture comprising mono- and diesters of DDSA with PG. The relative proportion of reactants may comprise from about 0.6 to about 0.95 moles PG per mole of DDSA, preferably from about 0.65 to about 0.9 moles PG per mole DDSA and more preferably from about 0.7 to about 0.85 moles PG per mole of DDSA.

The DDSA-PG adduct mixture is preferably dissolved in a heavy aromatic hydrocarbon diluent. The diluent is typically selected by criteria including relatively low volatility for reduced flammability hazard, low toxicity and single phase compatibility with other 2-cycle engine oil additive packages. An example includes mixtures of naphthalene and heavy aromatic naphtha. Typically, the present corrosion-inhibiting composition comprises the DDSA-PG adduct, and the aromatic solvent in an amount from about 20 to about 80 percent by weight, preferably about 30 to about 70 percent by weight and more preferably about 40 to about 60 percent by weight of the composition.

A typical procedure for preparation of the rust and corrosion inhibiting agent of the present invention comprises reacting dodecenylsuccinic anhydride and propylene glycol in the heavy aromatic solvent at a suitable temperature. The reaction temperature should be high enough to promote the reaction rate yet avoid degradation of the DDSA, preferably between about 100° C. and about 150° C. Reactants are charged into the reaction vessel in batches at the suitable molar ratio. Solvent may then be added to produce the desired diluted concentration. Generally, any large kettle reactor vessel having an agitation means, condensing means and heating means is suitable. Reaction extent may be determined based upon an infrared spectrograph of the reaction effluent. When the anhydride signature in the spectrograph disappears, the reaction is complete. Reaction time is generally 3–7 hours depending upon the reaction conditions and relative proportions of propylene glycol and DDSA in the reaction feed stream. The greater the proportion of propylene glycol, generally the shorter the reaction time, presumably due to excess hydroxyl radicals present.

The diluent-dissolved corrosion inhibitor adduct mixture has undergone compatibility tests with several common metallic and synthetic materials. Compatibility was determined based on observed appearance and/or weight loss following a one week immersion at 130° F. Incompatible materials include natural rubber, vinyl, polyethylene, neoprene rubber, poly(vinyl chloride), HYPALON, buna-n, PLEXIGLASS, ethylene-propylene rubber, and polyurethane. Compatible materials include TEFLON, polypropylene, VITON, PLASITE 10-6000, PLASITE 10-7122, PLASITE 8-4300, brass, 304 SS, 316 SS, and copper.

The rust and corrosion inhibitor composition described hereinabove may be used in 2-cycle engine oils as a corrosion inhibitor additive. Normally, the oil and the diluent/adduct mixture is blended in a masterbatch containing the DDSA-PG adduct in a concentration of from about 4.5 to about 5.5 percent by weight of the masterbatch. The masterbatch is then blended with additional oil so that the corrosion-inhibited oil product generally comprises the DDSA-PG adduct in an amount of from about 1 to about 5 pounds per thousand barrels (ptb) of the oil, preferably from about 2 to about 4 ptb of the final product.

The present invention can be more fully understood by reference to the following examples.

EXAMPLE 1

An adduct of dodecenylsuccinic anhydride (DDSA) and propylene glycol (PG) was prepared by mixing 40.5 grams of DDSA and 9.5 grams of PG in a temperature-controlled round bottom flask equipped with a magnetic stirrer and a condenser. The mixture was then dissolved in 50 grams of an aromatic solvent. The molar ratio of PG:DDSA was 0.82:1. The mixture was heated and the temperature maintained at 130° C. with constant stirring for 7 hours. Periodically (about 30–60 minutes), a small aliquot was removed for testing by IR spectroscopy.

COMPARATIVE EXAMPLES 1–11

Other adduct products with DDSA were prepared as outlined in Example 1 for comparative testing. Polyalcohols included 1,4-butanediol (1,4-BD), dipropylene glycol (DPG), ethylene glycol (EG) and triethanolamine (TEA). In addition, adducts of DDSA and PG were prepared at proportions outside of the specification of this invention. Comparative Example 11 is an oil sample containing no adduct additive. The sample size was based on a 0.2 g-mole sample of the DDSA. The aromatic solvent was 50 percent by weight of the reaction mixtures. IR aliquots were removed periodically (approximately 0.5–1 hr) to determine reaction completion. Reaction data for Example 1 and Comparative Examples 1–11 are shown in Table I.

TABLE I

| ADDUCT EXAMPLE | MOLAR PROPORTIONS DDSA | PG | EG | DPG | TEA | 1,4-BD | TEMP. (°C.) | REACTION TIME (hours) |
|---|---|---|---|---|---|---|---|---|
| 1 | 1 | 0.82 | — | — | — | — | 130 | 7 |
| Comp. 1 | 1 | 1 | — | — | — | — | 130 | 4 |
| Comp. 2 | 2 | 1 | — | — | — | — | 95–100 | 23 |
| Comp. 3 | 2 | — | — | — | — | 1 | 95–100 | 4 |
| Comp. 4 | 2 | — | — | — | — | 1.5 | 130 | 4 |
| Comp. 5 | 2 | — | 1 | — | — | — | 95–100 | 15 |
| Comp. 6 | 2 | — | 1.5 | — | — | — | 130 | 5 |
| Comp. 7 | 2 | — | — | 1 | — | — | 95–100 | 9 |
| Comp. 8 | 2 | — | — | 1.5 | — | — | 130 | 4 |
| Comp. 9 | 3 | — | — | — | 1 | — | 95–100 | 6.5 |
| Comp. 10 | 3 | — | — | — | 2 | — | 130 | 5 |
| Comp. 11 | Blank | | | | | | | |

CORROSION TESTING

Corrosion susceptibility testing of 2-cycle engine oils in water contact was determined according to ASTM-D665B. This test evaluates the corrosion inhibiting properties of various additives. Briefly, the test procedure generally consisted of steel coupons rotated in a heated bath of test oil and synthetic sea water at 60° C. for 24 hours. Round coupons were carefully cleaned and polished prior to use. In a glass beaker heated in an oil bath, 30 ml of sea water was added to 300 ml of test oil to initiate the procedure.

Corrosion Testing was performed on the adduct products of Example 1 and Comparative Examples 1–11. Results appear in Table II.

TABLE II

| ADDUCT EXAMPLE | CONCENTRATION (ptb) | CORROSION Rating | Rust (%) |
|---|---|---|---|
| 1 | 2 | B+ | 5 |
| Comp. 1 | 2 | D | 60 |
| Comp. 2 | 2 | B+ | 1 |
| Comp. 3 | 2 | B | 10 |
| Comp. 4 | 2 | B | 20 |
| Comp. 5 | 2 | B+ | 1 |
| Comp. 6 | 2 | B+ | 2 |
| Comp. 7 | 2 | C | 35 |
| Comp. 8 | 2 | C | 40 |
| Comp. 9 | 2 | C | 40 |
| Comp. 10 | 2 | B | 20 |
| Comp. 11 | Blank | E | 100 |

Results indicate that the adduct of the present invention is a suitable anti-rust agent. The other suitable rust inhibitors (Comparative Examples 2, 5 and 6) either failed the performance testing hereinbelow and/or fell outside the compositional criterion determined by molar proportion of the adduct reactants.

WSIM

The water separation index modification test (WSIM) was determined according to ASTM D-3948-87. This test evaluates the emulsion characteristics of fuels containing 2-cycle engine oils. A Micro-Separometer available from EMCEE Electronics, Inc. of Venice, Fla. was used as the testing apparatus. Briefly, the procedure involved preparing a water/fuel sample emulsion in a syringe using a high speed mixer and forcing the emulsion from the syringe at a programmed rate through a fiberglass coalescer. The effluent was analyzed for uncoalesced water by a light transmission measurement. The results are reported on a 0 to 100 scale. High ratings indicate that the water is easily coalesced, and imply that the 2-cycle engine oil containing the corrosion inhibiting additive does not contribute to emulsion formation in such fuels. A satisfactory reading is 80 or above.

WSIM tests were performed on the adduct mixtures prepared as in Example 1 and Comparative Examples 1-11. Results presented in Table III show that the present invention adduct gave satisfactory results (≧80 percent phase separation compared to the control) and that the adduct in molar proportions of 1:2 and 1:1 PG:DDSA did not.

TABLE III

| ADDUCT EXAMPLE | CONCENTRATION (ptb) | WATER SEPARATION (% Phase Separation) |
|---|---|---|
| 1 | 8 | 86 |
| Comp. 1 | 8 | 78 |
| Comp. 2 | 8 | 68 |
| Comp. 3 | 8 | 96 |
| Comp. 4 | 8 | 82 |
| Comp. 5 | 8 | 85 |
| Comp. 6 | 8 | 69 |
| Comp. 7 | 8 | 83 |
| Comp. 8 | 8 | 93 |
| Comp. 9 | 8 | 55 |
| Comp. 10 | 8 | 44 |
| Comp. 11 | Blank | 98 |

NMMA

The NMMA 2-cycle engine oil filter plugging test (NMMA) is utilized to determine the tendency of an ashless 2-cycle engine oil containing the anti-corrosion additive to become gelled when contaminated with calcium containing, low-ash 2-cycle engine oils or any lubricant manufactured with organometallic components, and small quantities of water (such as water due to condensation). The procedure is performed as set forth as "NMMA TC-W II, 2-Cycle Engine Oils." Briefly, a test oil sample comprising any anti-corrosion additive was mixed with a low-ash, 2-cycle engine oil such as, for example, CITGO-93511. The mixture was split into two 60 ml sample aliquots. One was a control which was sealed and left undisturbed. To the other, 0.25 volume percent distilled water was added. The sample was sealed and vigorously shaken by hand. This sample was then set aside for 48 hours. If there was no visible indication of gelation, filtration was performed with a 25 ml burette equipped with a filter holder fitted with discs of OMC filter screen material cut to fit the holder. Flow rate of the test oil aliquot through the burette was determined. For a satisfactory test result, the test oil should have a flow rate not less than 80 percent of the control oil sample.

The NMMA 2-cycle engine filter plugging test was performed for an adduct-containing 2-cycle commercial test oil mixed with a low-ash, calcium-containing 2-cycle engine oil. The low-ash calcium-containing oil was obtained as CITGO 93511. The adduct was Example 1. The adduct-diluent concentration in the commercial oil was 0.72 percent by weight. At the molar ratio of about 0.82:1 PG:DDSA, satisfactory results were obtained. A prior art product comprising 50 percent by weight dimer acid in a solvent gelled in 48 hr thereby failing the test.

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

What is claimed is:

1. A corrosion-inhibiting 2-cycle engine oil, comprising:

from about 1 to about 5 ptb of a dodecenylsuccinic anhydride-propylene glycol adduct comprising a mixture of mono- and diesters of dodecenyl succinic anhydride substantially free of unreacted dodecenylsuccinic anhydride obtained by reacting from about 0.6 to about 0.95 moles of propylene glycol per mole of dodecenylsuccinic anhydride in an aromatic diluent.

2. The engine oil of claim 1, comprising from about 2 to about 4 ptb of said adduct.

3. The engine oil of claim 1, wherein said adduct is obtained by reacting from about 0.65 to about 0.9 moles propylene glycol per mole of dodecenylsuccinic anhydride.

4. The engine oil of claim 1, wherein said adduct is obtained by reacting from about 0.7 to about 0.85 moles propylene glycol per mole of dodecenylsuccinic anhydride.

5. A method for preparing a 2-cycle engine oil corrosion inhibitor, comprising the steps of:

(a) charging a reaction vessel with a feed mixture of propylene glycol and dodecenylsuccinic anhydride in a proportion of from about 0.6 to about 0.95 moles of said glycol per mole of said anhydride;

(b) diluting said feed mixture with an aromatic diluent;

(c) reacting said mixture at an elevated temperature to form an adduct comprising the mono- and diesters of propylene glycol and dodecenylsuccinic anhydride substantially free of unreacted dodecenylsuccinic anhydride; and (d) blending the reaction product of step (c) with 2-cycle engine oil in an amount of from about 1 to about 5 pounds per thousand barrels.

6. The method of claim 5, wherein said proportion of glycol:anhydride is from about 0.65 to about 0.9:1.

7. The method of claim 5, wherein said proportion of glycol:anhydride is from about 0.7 to about 0.85:1.

8. The method of claim 5, wherein said reaction is for a period of time of from about 3 to about 7 hours.

9. The method of claim 5, wherein said diluent is an aromatic solvent comprising from about 20 to about 80 percent by weight of said feed mixture.

10. The method of claim 5, wherein said diluent is an aromatic solvent comprising from about 30 to about 70 percent by weight of said feed mixture.

11. The method of claim 5, wherein said diluent is an aromatic solvent comprising from about 40 to about 60 percent by weight of said feed mixture.

12. The method of claim 5, wherein said blending step comprises preparing a masterbatch of the reaction product of step (c) in 2-cycle engine oil and mixing said masterbatch with an additional amount of said oil.

13. The method of claim 12, wherein said masterbatch comprises from about 4.5 to about 5.5 percent by weight of said adduct.

* * * * *